US009746158B2

(12) United States Patent
Xu

(10) Patent No.: US 9,746,158 B2
(45) Date of Patent: Aug. 29, 2017

(54) THEFTPROOF LAMP

(75) Inventor: Yunfei Xu, shanghai (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/236,084

(22) PCT Filed: Jul. 25, 2012

(86) PCT No.: PCT/IB2012/053773

§ 371 (c)(1),
(2), (4) Date: Jan. 30, 2014

(87) PCT Pub. No.: WO2013/017992

PCT Pub. Date: Feb. 7, 2013

(65) Prior Publication Data

US 2014/0204596 A1 Jul. 24, 2014

(30) Foreign Application Priority Data

Aug. 2, 2011 (WO) ..... PCT/CN2011/001266

(51) Int. Cl.
*H01R 33/00* (2006.01)
*F21V 15/00* (2015.01)
(Continued)

(52) U.S. Cl.
CPC ..... *F21V 15/005* (2013.01); *F21V 17/10* (2013.01); *H01K 1/465* (2013.01); *F21K 9/23* (2016.08);
(Continued)

(58) Field of Classification Search
CPC ..... F21V 15/005; H01K 1/465
(Continued)

(56) References Cited

U.S. PATENT DOCUMENTS 1,575,992 A * 3/1926 Hubbell ..... 313/318.04
1,676,323 A * 7/1928 Clemetson ..... H01R 33/971 313/51
(Continued)

FOREIGN PATENT DOCUMENTS

CH 131220 A * 10/1923
CH 131220 A 1/1929
(Continued)

OTHER PUBLICATIONS

Machine translation of CH-291664 to Roesch & Co, published Jun. 6, 1953.*

*Primary Examiner* — Peggy Neils
*Assistant Examiner* — William N Harris

(57) ABSTRACT

A theftproof lamp (100), including a lamp body (110) and a lamp cap (120). A spring member (140) and a ratchet wheel mechanism (130) are provided inside the lamp for cooperating with each other and enabling theftproof effect. When turning the lamp clockwise, the lamp can be screwed down to a lamp socket. When turning the lamp counter-clockwise, the lamp can only make repetitive circular motions around the ratchet wheel and therefore achieve the theftproof effect. When a user needs to remove the lamp in a safe way, a bolt (170) can be moved inwardly to block the spring member from moving upward, so that the lamp body, ratchet wheel and lamp cap form a whole, without any movement in relation to each other, and therefore allowing easy removal of the lamp.

6 Claims, 2 Drawing Sheets

(51) Int. Cl.

| | |
|---|---|
| ***F21V 17/10*** | (2006.01) |
| ***H01K 1/46*** | (2006.01) |
| ***F21Y 101/00*** | (2016.01) |
| *F21K 9/23* | (2016.01) |
| *F21Y 115/10* | (2016.01) |

(52) U.S. Cl.
CPC ..... *F21Y 2101/00* (2013.01); *F21Y 2115/10* (2016.08)

(58) Field of Classification Search
USPC ..... 362/282, 378, 457, 458, 376, 353, 655, 362/656
See application file for complete search history.

(56) References Cited

U.S. PATENT DOCUMENTS

| | | | | |
|---|---|---|---|---|
| 2,842,700 | A * | 7/1958 | Jacobs | 313/318.04 |
| 5,788,525 | A | 8/1998 | Newman et al. | |
| 5,980,072 | A | 11/1999 | Zirkle | |
| 6,338,565 | B1 * | 1/2002 | Fager | F21V 15/00 362/311.01 |
| 6,494,730 | B1 | 12/2002 | Yan | |
| 8,858,042 | B2 * | 10/2014 | Chang | F21V 3/02 362/362 |
| 2002/0118549 | A1 * | 8/2002 | Esser et al. | 362/549 |
| 2005/0231951 | A1 | 10/2005 | Hirsch et al. | |
| 2006/0126345 | A1 * | 6/2006 | Chen | 362/353 |
| 2012/0063864 | A1 * | 3/2012 | Hess | F16B 39/24 411/326 |
| 2013/0250583 | A1 * | 9/2013 | Chang | F21V 3/02 362/362 |

FOREIGN PATENT DOCUMENTS

| | | | | |
|---|---|---|---|---|
| CH | 291664 | A | * | 6/1953 |
| CH | 291664 | A | | 6/1953 |
| CN | 2954334 | Y | | 1/2007 |
| CN | 101994915 | A | | 3/2011 |
| DE | 362279 | C | | 10/1922 |
| DE | 202008015047 | U1 | | 4/2010 |
| DE | 202009014100 | U1 | | 3/2011 |
| JP | 2014527681 | A | | 10/2014 |
| WO | WO2004057639 | A1 | | 7/2004 |

* cited by examiner

THEFTPROOF LAMP

BACKGROUND

Technical Field

The present invention generally relates to the field of lighting, specifically to a theftproof lamp.

Brief Description of Prior Arts

It is known in the lighting field that high-end lamps can be very expensive, such as those installed in large stadiums or luxury hotels. Accordingly, these expensive lamps face the risk of being stolen. Typical theftproof CFL structures are quite complex, because CFL can provide bigger rooms and simpler electrical circuits for the complex structure. For example, an annular CFL is provided with a thick enough and long enough needle inside for unlocking the theftproof lock. Another shortcoming of these theftproof CFL structures lies in their elastic sheet, which is pushed down and rises up when the lamp is being turned in one direction and cannot be taken away without the key (the long and thick needle). In addition, the elastic sheet is easily worn out and loses its elasticity and doesn't work again. Therefore, when real users try to take the CFL off from the lamp holder by turning the lamp, the lamp cannot be taken away and can only make repetitive circular motion.

SUMMARY OF THE PRESENT INVENTION

One objective of the present invention is to furnish a theftproof lamp that has a simple structure and is less likely to fail when the lamp needs to be removed from a fixture by real users, instead of thieves.

According to the present invention, the theftproof lamp includes a lamp base and a lamp body. The lamp body includes a spring member. The lamp base includes a ratchet wheel and an exterior surface configured to mechanically engage with a lamp socket. The spring member is configured to mechanically engage with the ratchet wheel to allow the lamp body and the lamp base to rotate only in one direction with respect to one another. When turning the lamp clockwise, the lamp can be screwed down to the lamp holder. When turning the lamp counter-clockwise, the lamp can only make repetitive circular motion around the ratchet wheel mechanism and therefore cannot be taken away.

In some embodiments of the present invention, when the real users need to take away the lamp, a bolt in the spring member can be adjusted to block a needle-like structure in the spring member, which is engaged with the ratchet wheel mechanism, so that the lamp can be taken away in a safe way.

a. Any of the embodiments of the present invention can realize one or more of the following advantages: The combination of the ratchet wheel mechanism and the spring member is reliable for use and prevents the failure of taking away lamps when real users need to do that in a safe way.

b. The ratchet wheel and the spring member both have a simple structure, which is not only good for conventional lamps, which can provide large internal spaces, but also for LED lamps, which can have complex electrical circuits and, therefore, smaller internal space.

DETAILED DESCRIPTION OF PREFERRED EMBODIMENTS

Embodiments of the present invention will be described more fully hereinafter with reference to the accompanying drawings, in which embodiments of the invention are shown. This invention can, however, be embodied in many different forms and should not be construed as limited to the embodiments set forth herein. Like numbers refer to like elements throughout.

Figure 1:
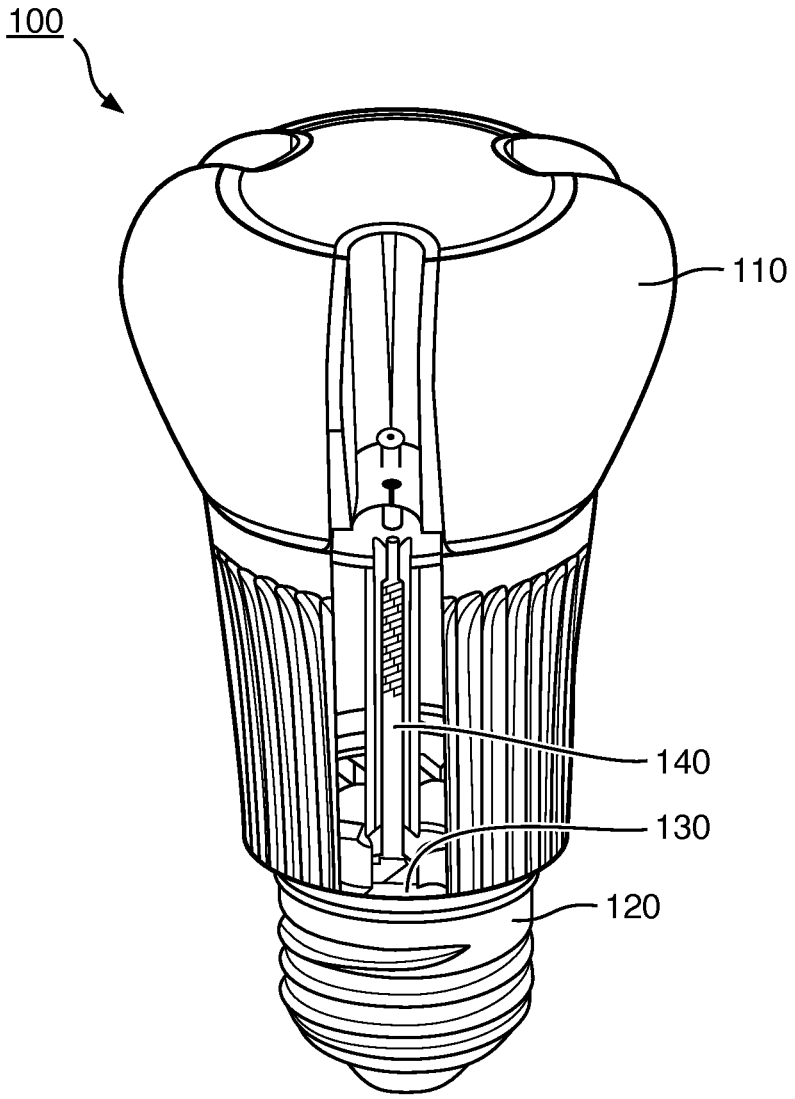
FIG. 1 is a schematic illustrating the internal structure of a lamp according some embodiments of the present invention.

FIG. 1 is a schematic illustrating the internal structure of a lamp 100 according to some embodiments of the present invention. As FIG. 1 shows, the embodiment takes a LED lamp 100 as an example to show that even in a complex LED lamp, the simple structure of the present invention can be implemented therein. The LED lamp 100 includes a lamp body 110 (e.g., a light-emitting portion and/or a portion containing driver electronics) and a lamp cap 120 (e.g., a base configured to mechanically engage with a socket of a fixture). A ratchet wheel mechanism 130 is provided, for example, at the joining part of the lamp body 110 and the lamp cap 120. In some embodiments, the ratchet wheel mechanism 130 can be positioned within the lamp cap 120 and/or within the lamp body 110. The ratchet wheel mechanism 130 can be fixed to the lamp cap 120. A spring member 140 is provided above the ratchet wheel mechanism. In some embodiments, lamp 100 can include more than one spring member 140.

Figure 2:
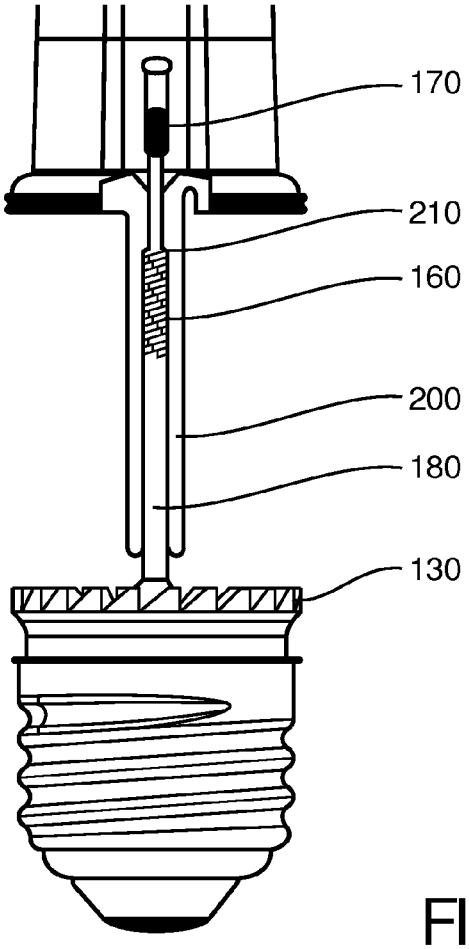
FIG. 2 is a schematic illustrating the internal structure of the spring member of some embodiments of the present invention.
Figure 3:
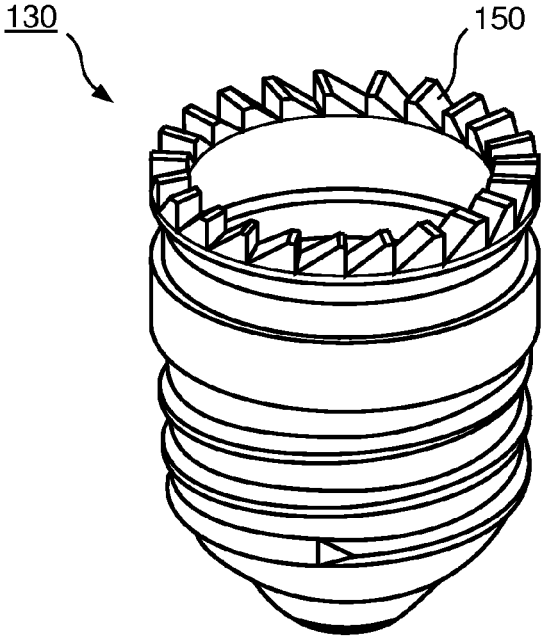
FIG. 3 is a schematic illustrating the internal structure of the ratchet wheel mechanism of some embodiments of the present invention.

FIG. 2 is a schematic illustrating the internal structure of the spring member 140 of some embodiments of the present invention. FIG. 3 is a schematic illustrating the internal structure of the ratchet wheel mechanism 130 of some embodiments of the present invention. In some embodiments, the ratchet wheel mechanism 130 is a ratchet wheel with multiple sloping teeth 150. Each of the sloping teeth 150 has a vertical surface and a sloping surface. In some embodiments, only a subset of the sloping teeth 150 have vertical surfaces. The spring member 140 includes a spring 160 set in the lamp body 110, a bolt 170 capable of being positioned within or close to the spring 160, and a needle-like structure 180 with the upper part being wrapped up by the spring 160 and the lower part located underneath the spring. The bolt 170 can be inserted into the spring 160 from outside. In some embodiments, at least a portion of the bolt 170 is fixed on the outside surface of the lamp body 110. The spring 160 can be positioned at an upper part of the needle-like structure 180 so that it elastically engages with the needle-like structure 180. For example, the diameter of the upper part of the needle-like structure 180 can be thinner than the inside diameter of the spring. The diameter of the lower part of the needle-like structure 180 can be larger than the outside diameter of the spring. In general, the needle-like structure can include any elongated structure such as, for example, a cylinder. A protective sleeve 200 can be fixed on the inner surface of the lamp body 110 and can cover the spring member 140.

The lower part of the needle-like structure 180 can be configured in a shape to engage with the ratchet wheel 130. For example, the lower part of the needle-like structure 180 can include a vertical surface to engage with the vertical surfaces of the sloping teeth 150. The lower part of the needle-like structure 180 can also include a sloping surface to engage with the sloping surfaces of the sloping teeth 150.

In some embodiments, the lamp body 110 and the lamp cap 120 are fixed together in a direction parallel to the spring member 140 (e.g., the lamp body 110 and the lamp cap 120 are not free to come apart in an axial direction, but may be free to be rotatable with respect to one another). When the lamp 100 is turned clockwise, from the perspective of looking down on the lamp body 110, the vertical surfaces of the sloping teeth 150 can prevent the lamp body 110 and the lamp cap 120 from rotating with respect to one another. Accordingly, clockwise rotation of the lamp body 110 will force a similar clockwise rotation of the lamp cap 120, thereby allowing the lamp cap 120 to engage mechanically with a compatibly-sized lamp socket.

On the other hand, when the lamp 100 is turned counter-clockwise, the needle-like structure 180 can engage with the sloping surface of any sloping tooth 150, which will exert an upward force on the needle-like structure 180 and push the needle-like structure 180 upward and over the sloping tooth 150. Because the spring 160 can be elastically in contact with the needle-like structure 180 and a blocking structure 210 can be set either on an internal surface of the lamp body 110 or on an internal surface of the protective sleeve 200, the spring is blocked by the blocking structure 210 and therefore generates a counterforce to push the needle-like structure 180 into another adjacent tooth 150. The blocking structure 210 in some embodiments is disposed on the internal surface of the protective sleeve 200. By allowing the needle-like structure 180 to move upward and over the sloping teeth 150, the lamp body 110 and the lamp cap 120 will rotate with respect to one another. Accordingly, rotation of the lamp 100 in the counter-clockwise direction will not result in any movement in the lamp cap 120 and, therefore, removal of the lamp 100 by, e.g., a thief from the fixture can be prevented.

In some embodiments, the lamp body 110 can be allowed to be removed from the lamp socket in a safe way, without damaging the lamp. By allowing the lamp body 110 to be removable from a socket, the lamp can be repaired and/or changed. The lamp body 110 can include a hole set on an outside surface of the lamp body 110. The bolt 170 can extend from the hole into the internal space of the lamp body 110, e.g., into the spring 160. In an anti-theft state, the bolt 170 is positioned at a minimum distance away from the needle-like structure 180 such that it will not come into contact with the needle-like structure 180, even if the needle-like structure 180 is pushed upward by the sloping surface of the sloping teeth 150. However, when users need to disengage the lamp from the lamp holder (e.g., unscrew), the bolt 170 can be moved (e.g., turned and/or pushed) inwardly a sufficient distance to prevent the needle-like structure 180 from being pushed upwards by the sloping surfaces of the ratchet wheel 130. In the removal state, the resistance of the bolt 170 will not allow the needle-like structure 180 to move over the sloping teeth 150. Therefore, when the lamp 100 is turned counter-clockwise while in a removal state, the resistance provided by the bolt 170 can prevent the lamp body 110 and the lamp cap 120 from rotating with respect to one another. Accordingly, counter-clockwise rotation of the lamp body 110 in the removal state will force a similar counter-clockwise rotation of the lamp cap 120, thereby allowing the lamp cap 120 to disengage mechanically with the lamp socket.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements other than those listed in a claim. The word "a" or "an" preceding an element does not exclude the presence of a plurality of such elements.

What is claimed is:

1. A lamp comprising:

a lamp body, including a lighting element and a spring member, wherein the spring member includes a spring and an elongated member, the elongated member terminating with a sloped surface; and a lamp base including an exterior surface configured to mechanically engage with a lamp socket, the lamp base having a connection end and an insertion end, the connection end being connected to the lamp body such that the lamp base is configured to be axially inseparable from the lamp body but rotatable with respect to the lamp body, the insertion end positioned to be seated further in the lamp socket than the connection end when the lamp base is mechanically engaged with the lamp socket; and a ratchet wheel, having a plurality of teeth, disposed on the connection end of the lamp base, such that at least a portion of the lamp base is seated further in the lamp socket than the ratchet wheel when the lamp base is mechanically engaged with the lamp socket, wherein the spring biases the elongated member such that the sloped surface of the elongated member mechanically engages with the teeth of the ratchet wheel such that the lamp body is allowed to rotate only in one direction with respect to the lamp base, wherein, when the spring member is constrained from axial movement, the sloped surface is held against the teeth of the ratchet wheel, preventing the lamp body from rotating in any direction with respect to the lamp base.

2. The lamp of claim 1, wherein the teeth of the ratchet wheel comprise a plurality of sloping teeth each having a vertical side surface and a sloping side surface, wherein the ratchet wheel is fixed together with the lamp base.

3. The lamp of claim 1, wherein the spring of the spring member is positioned in the lamp body wherein the lamp further comprises:

a movable bolt fixed on an outside surface of the lamp body and including a portion that extends beyond the lamp body, the movable bolt configured to be inserted into or next to the spring;

wherein the elongated structure includes an upper part positioned within the spring and a lower part located underneath the spring, wherein when the movable bolt is inserted into or next to the spring the elongated structure is constrained from axial movement.

4. The lamp of claim 3, wherein a diameter of the upper part of the elongated structure is thinner than an inside diameter of the spring, and wherein a diameter of the lower part of the elongated structure is larger than an outside diameter of the spring.

5. The lamp of claim 3, further comprising a protective sleeve covering the spring member.

6. A lamp comprising:

a lamp body including a spring member, the spring member being disposed within the lamp body and having an antitheft position and a removal position, the spring member comprising:

a spring; and an elongated structure, wherein the elongated structure is engaged with and disposed within the spring; and a movable bolt; and a lamp base including a ratchet wheel and an exterior surface configured to mechanically engage with a lamp socket, wherein the spring biases the elongated member such that the elongated member mechanically engages with the teeth of the ratchet wheel, wherein, in the antitheft position the movable bolt is positioned so that it will not come into contact with the elongated structure such that the elongated structure is configured to mechanically engage with the ratchet wheel to allow the lamp body and the lamp base to rotate only in one direction with respect to one another, wherein, in the removal position, the movable bolt is positioned to constrain the elongated structure from axial movement such that the elongated structure will remain in constant contact with the ratchet wheel, allowing the lamp body and the lamp base to rotate together in both directions.

* * * * *